US005893702A

United States Patent [19]

Conrad et al.

[11] Patent Number: 5,893,702

[45] Date of Patent: Apr. 13, 1999

[54] GAS FRICTION PUMP

[75] Inventors: Armin Conrad, Herborn; Heinrich Lotz, Wetzlar; Carsten Reese, Asslar, all of Germany

[73] Assignee: Pfeiffer Vacuum GmbH, Asslar, Germany

[21] Appl. No.: 08/906,362

[22] Filed: Aug. 5, 1997

[30] Foreign Application Priority Data

Aug. 10, 1996 [DE] Germany ..... 196 32 375

[51] Int. Cl.[6] ..... F04D 19/04

[52] U.S. Cl. ..... 415/71; 415/73; 415/83; 415/90

[58] Field of Search ..... 415/71, 73, 77, 415/83, 84, 90, 143; 417/423.4

[56] References Cited

U.S. PATENT DOCUMENTS

| | | | |
|---|---|---|---|
| 2,730,297 | 1/1956 | Van Dorsten et al. | 415/90 |
| 4,655,678 | 4/1987 | Miki | 415/90 |
| 4,787,829 | 11/1988 | Miyazaki et al. | 415/90 |
| 5,116,196 | 5/1992 | Baret et al. . | |
| 5,733,104 | 3/1998 | Conrad et al. | 417/423.4 |

FOREIGN PATENT DOCUMENTS

| | | | |
|---|---|---|---|
| 0260733 | 3/1988 | European Pat. Off. . | |
| 0779434 | 6/1997 | European Pat. Off. . | |
| 0805275 | 11/1997 | European Pat. Off. . | |
| 1010235 | 6/1957 | Germany . | |
| 2526164 | 12/1976 | Germany . | |
| 4113122 | 10/1991 | Germany . | |
| 61-145394 | 7/1986 | Japan | 415/90 |
| 62-195491 | 8/1987 | Japan | 415/90 |
| 5-248386 | 9/1993 | Japan | 415/73 |

*Primary Examiner*—Christopher Verdier
*Attorney, Agent, or Firm*—Anderson, Kill & Olick, P.C.

[57] ABSTRACT

A gas friction pump including a rotor located in the pump housing and formed of a plurality of coaxial first cylindrical elements, and a stator located in the housing and formed of a plurality of second cylindrical elements coaxial with the first cylindrical elements and surrounding respective first cylindrical elements, with the first cylindrical elements or the second cylindrical elements having smooth inner and outer surfaces, and another ones of the first cylindrical elements and the second cylindrical elements have a plurality of parallel discharge channels formed on their inner and outer surfaces, arranged one beneath another and separated by a respective plurality of webs, the parallel discharge channels defining a plurality of parallel discharge chambers forming a plurality of parallel operating pumping chambers for pumping gas form the suction port to the discharge port.

11 Claims, 3 Drawing Sheets

GAS FRICTION PUMP

BACKGROUND OF THE INVENTION

1. Field of the Invention

The present invention relates to a gas friction pump including a cylindrical rotor element, a cylindrical stator element surrounding the rotor element, and a plurality of parallel, arranged beneath each other, discharge channels formed by spiral grooves and separated by webs, with the discharge channels forming a discharge chamber which provides for pumping gas from the pump suction port to the pump discharge port.

2. Description of the Prior Art

Different types of gas friction pumps are used for gas delivery. Their operation is based on the transfer of pulses from movable walls to gas particles. In this way, a gas flow in a predetermined direction is created. Gas friction pumps, which function in a pressure region in which a free path length of gas molecules is large in comparison with geometrical dimensions of a pump, i.e., which function in a molecular flow region, are called molecular pumps.

A first gas friction pump of this type was proposed by Gaede. A further modification of a Gaede pump, without changing its basic principle, was made by Siegbahn. In Siegbahn pump, a rotatable disc is used as a movable wall.

Another modification of the Gaede pump was made by Holweck. In the Holweck pump, a cylinder surface serves as a movable wall.

A large advance in a further development of gas friction pump was made by Becker. In the pump construction of Becker, movable and stationary walls are alternatively arranged one behind the other, with both movable and stationary walls being formed as turbine disc provided with vanes. These pumps were called turbomolecular pumps.

All of the above-mentioned gas friction pumps play an ever increasing role in vacuum technology, in particular, in high and ultrahigh vacuum technology. At that, the Becker turbomolecular pump is used on one side of a vacuum system, and a gas friction pump of Gaede, Holweck, or Siegbahn is used on the opposite side. A multi-stage turbomolecular pump permits to obtain high pressure ratios and, therefore, is particularly suitable for use in a high and ultrahigh vacuum region. However, their application range is limited by their inability to operate in the region of higher pressures. Therefore, because of large distances between the pump elements they are fully operational only at low pressures of about $10^{-3}$ mbar.

The Gaede, Siegbahn and Holweck gas friction pumps are suitable for application in the above-discussed pressure region. They can be used in this region separately or be consecutively connected with a turbomolecular pump. The combination of turbomolecular pumps with gas friction pumps permits to shift the operational region of the turbomolecular pumps toward the region of higher discharge pressures.

However, the gas friction pumps have certain drawbacks which adversely affects their operation. It is important for a proper operation of the gas friction pumps that the distance between rotatable and stationary elements be very small to keep the backstreaming and discharge losses to a minimum. This is particularly applicable to Gaede, Siegbahn and Holweck pumps. In addition, these pumps, as well as the turbomolecular pumps, can function in the high pressure region and molecular flow region only then when the distance between the rotatable and stationary elements is small in comparison with the mean free path length of the molecules of a pumped gas. Only then, the gas friction pumps can achieve the full pressure ratio in the molecular flow region.

A narrow rotor-stator split is a necessary premise for proper functioning of the gas friction pumps. However, a narrow split leads to small dimensions of the discharge chamber and, thus, results in a limited suction capacity. Therefore, the gas compressed in a turbomolecular pump can be further upgraded only to a definite magnitude, so that its suction capacity is limited toward higher pressures. In order to further expand the operational range of the turbomolecular pumps toward a higher pressure region, they should be combined with gas friction pumps with a high suction capacity the geometrical dimensions of which permits them to operate in a molecular flow region.

The Gaede and Siegbahn gas friction pumps, because of their construction, cannot be modified so that their suction capacity substantially increases, without an adverse affect on their basic function. Moreover, they have specific drawbacks which reduce their efficiency in certain applications. For example, in the Siegbahn gas friction pump, the gas is pumped against a centrifugal force.

Accordingly, an object of the present invention is a gas friction pump operable in the molecular flow range and having a higher suction capacity than the conventional gas friction pumps.

Another object of the present invention is a gas friction pump the geometrical dimensions of which are comparable with the geometrical dimensions of conventional gas friction pumps.

A further object of the present invention is a gas friction pump operable in a combination with a turbomolecular pump.

SUMMARY OF THE INVENTION

These and other objects of the present invention, which will become apparent hereinafter, are achieved by providing a gas friction pump including a housing having a suction port and a discharge port. A rotor located in the housing and formed of a plurality of coaxial first cylindrical elements, and a stator located in the housing and formed of a plurality of second cylindrical elements coaxial with the first cylindrical elements and surrounding respective first cylindrical elements, with the first cylindrical elements or the second cylindrical elements having smooth inner and outer surfaces, and another ones of the first cylindrical elements and the second cylindrical elements having a plurality of parallel discharge channels formed on their inner and outer surfaces and arranged one beneath another and separated by a respective plurality of webs, with the parallel discharge channels defining a plurality of parallel discharge chambers forming a plurality of parallel operating pumping chambers for pumping gas from the suction port to the discharge port.

Parallel arrangement of the discharge chambers according to the present invention, which occupy substantially the same space as the discharge chamber of the conventional gas friction chambers, permits to increase the suction capacity of the inventive gas friction pump in several times in comparison with the suction capacity of the conventional gas friction pumps, with the inventive gas friction pump still being operable in the molecular flow range. This is very important for retaining the particular pumping characteristics of a gas friction pump, e.g., a high pressure ratio.

Providing, according to the present invention, a connection element for connecting the first cylindrical elements and arranged adjacent to the suction port, with the connection element having a plurality of openings for connecting the suction port with respective discharge chambers and including a plurality of bearing elements which form, together with the openings, a gas discharge structure.

The connection element according to the present invention permits to achieve a high conductance in the suction region of the inventive pump and provides for a most possible unobstructed delivery of a pumped gas from the suction port into the coaxial discharge chambers. The formation of the stator elements with a meander-shaped cross-section and with the discharge channels and the webs being formed on the inner and outer surfaces of the stator elements opposite each other leads to minimal space requirements and permits to use for their manufacture optimal manufacturing methods.

The differences in pressure ratios, which are caused by different circumferential speeds of the inner and outer cylindrical elements, can be increased by reducing axial expansion of the rotor and stator elements from inside out. This leads to the reduction of the rotor-stator discs split from outside inward and/or to the reduction of the discharge channel width from outside inward.

The advantages of the inventive gas friction pump become particularly noticeable when it is used in combination with a turbomolecular pump. The parallel arrangement of the discharge chambers and the particular construction of the inlet or suction region permits to obtain a very high suction capacity which enables to take over the gas at the fore-vacuum side of the turbomolecular along the entire periphery, without any noticeable loss, compress it and deliver it to the gas discharge port. This permits to expand the operational region of the turbomolecular pump in two times.

A further expansion of the operational region can be achieved by providing a row of gas friction pumps at the fore-vacuum side of the turbomolecular pump.

BRIEF DESCRIPTION OF THE DRAWINGS

The features and objects of the present invention will become more apparent, and the invention itself will be best understood from the following detailed description of the preferred embodiments when read with reference to the accompanying drawings, wherein.

DETAILED DESCRIPTION OF THE PREFERRED EMBODIMENTS

Figure 1:
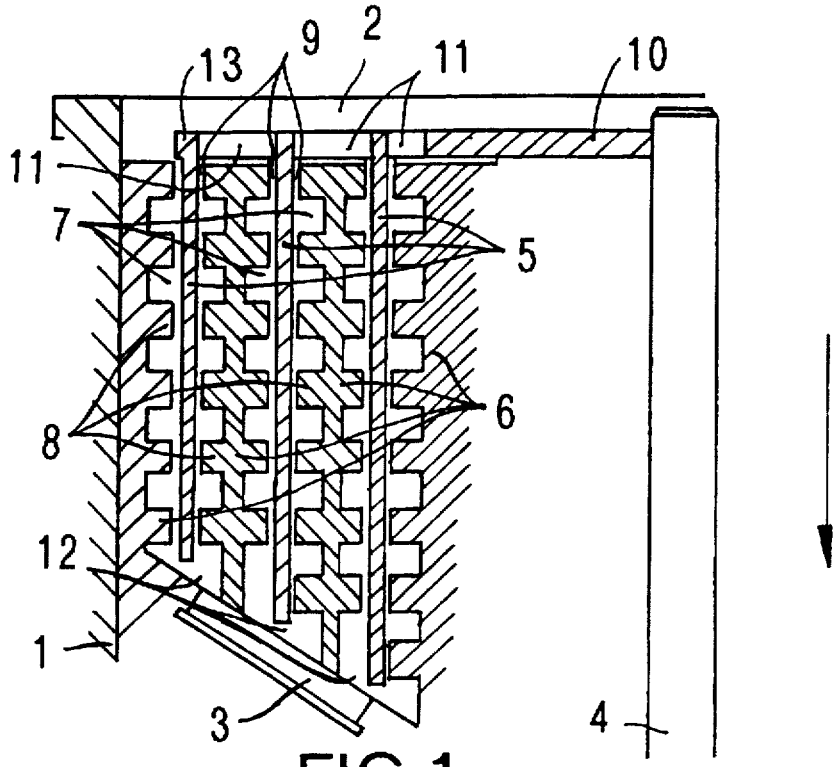
FIG. 1 shows a partial cross-sectional view of a first embodiment of a gas friction pump according to the present invention.

FIG. 1 shows a gas friction pump according to the present invention and including a housing 1 having a suction port 2 and a discharge port 3. A connection element 10 connects a plurality of coaxial cylindrical elements 5 with a shaft 4. The shaft 4, the coaxial cylindrical elements 5 and the connection element 10 form together a rotor unit. Means for driving and supporting the rotor unit are not shown in FIG. 1. This is because they are conventional and of no importance for the basic concept of the present invention. The stator is formed of a plurality of a coaxial cylindrical elements 6 which surround respective cylindrical rotor elements 5. The cylindrical stator elements 6 are provided with spiral discharge channels 7 separated from each other by webs 8. These discharge channels 7 are arranged, respectively, opposite outer or inner smooth surfaces of the rotor elements 5 and form coaxial discharge chambers 9 which serve as parallel pumping chambers which pump gas from suction port 2 to the discharge port 3. The parallel gas streams exit through openings 12 provided in the stator elements 6 at the ends of the discharge chamber and are combined in a single flow flowing to the discharge port 3.

Figure 2:
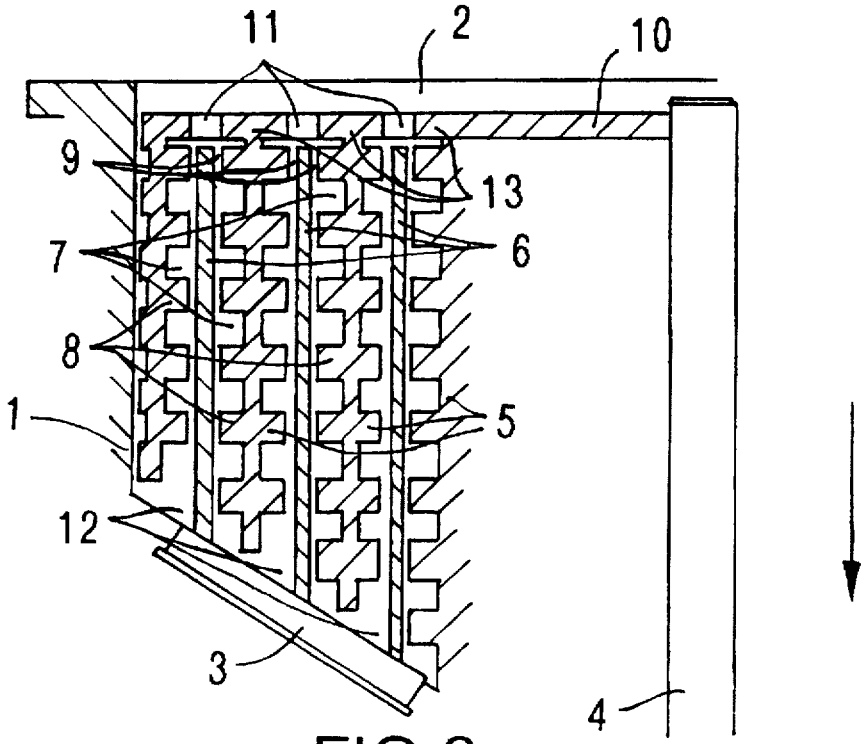
FIG. 2 shows a partial cross-sectional view of a second embodiment of a gas friction pump according to the present invention.

In the embodiment of a gas friction pump shown in FIG. 2, it is the cylindrical rotor elements 5 which are provided with the discharge channels 7, with the stator elements 6 having smooth surfaces.

Figure 3:
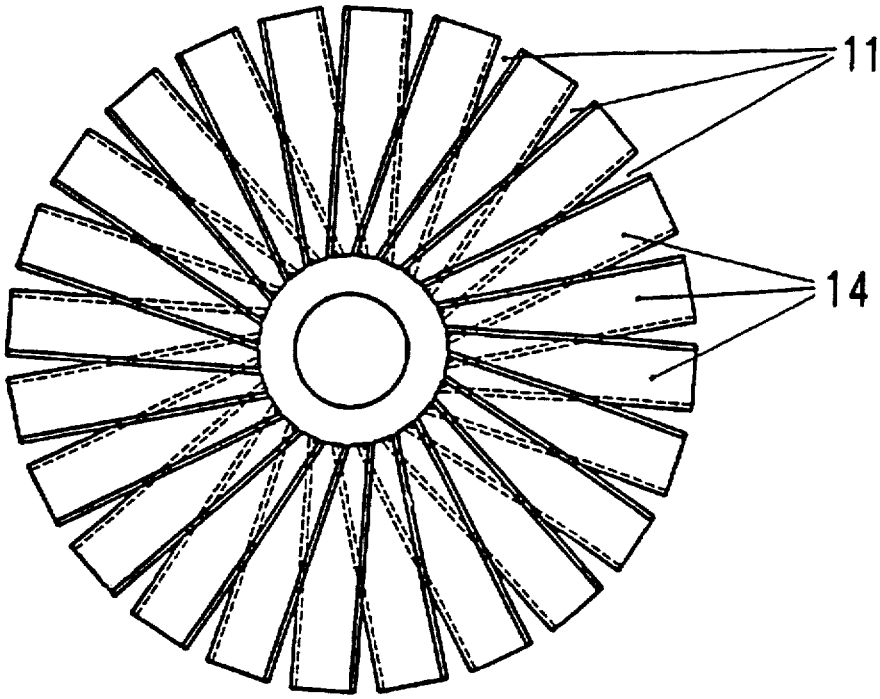
FIG. 3 shows a plan view of an element connecting the rotor cylindrical elements with each other.
Figure 4:
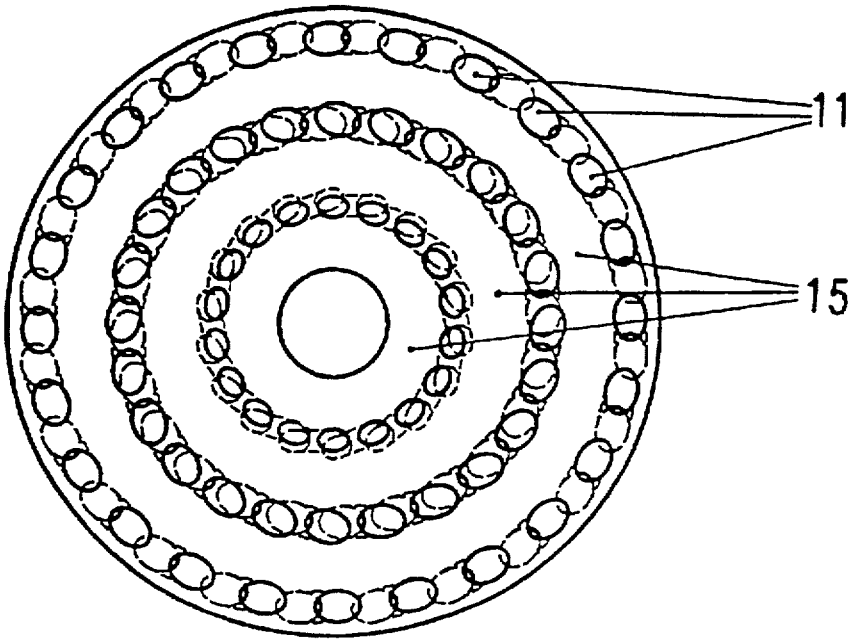
FIG. 4 shows a plan view of another embodiment of an element connecting the rotor cylindrical element with each other.

The connection element 10 is provided with openings 11 which connect the suction port 2 with respective discharge chambers 9. The bearing elements 13 of the connection element 10 can be so formed that they, together with the openings 12, form a gas discharge structure. In the connection element shown in FIG. 3, the gas discharge structure is formed by vanes 14 extending at an angle to the suction port 2. In the connection element 10 shown in FIG. 4, the gas discharge structure is formed by inclined bores 15.

Figure 5:
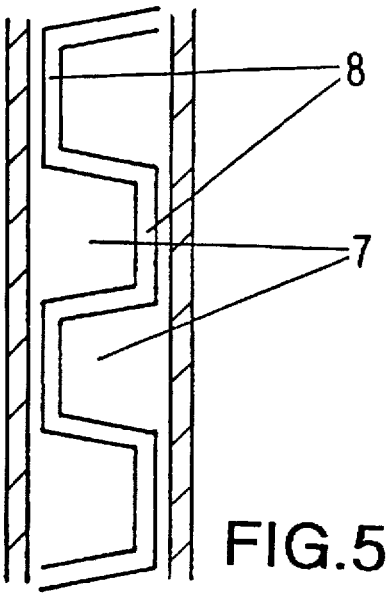
FIG. 5 shows a partial cross-sectional view of a discharge channel.

FIG. 5 shows an embodiment of a cylindrical element 5 or 6 which is provided with discharge channels. In FIG. 5, the discharge channels have a meander-shaped structure. Thereby, the discharge channels 7 and the webs 8 provided on the inner and outer sides of a cylindrical element are arranged against each other. This insures an optimal utilization of the available space and permits to obtain a more compact structure having the same suction capacity.

Figure 6:
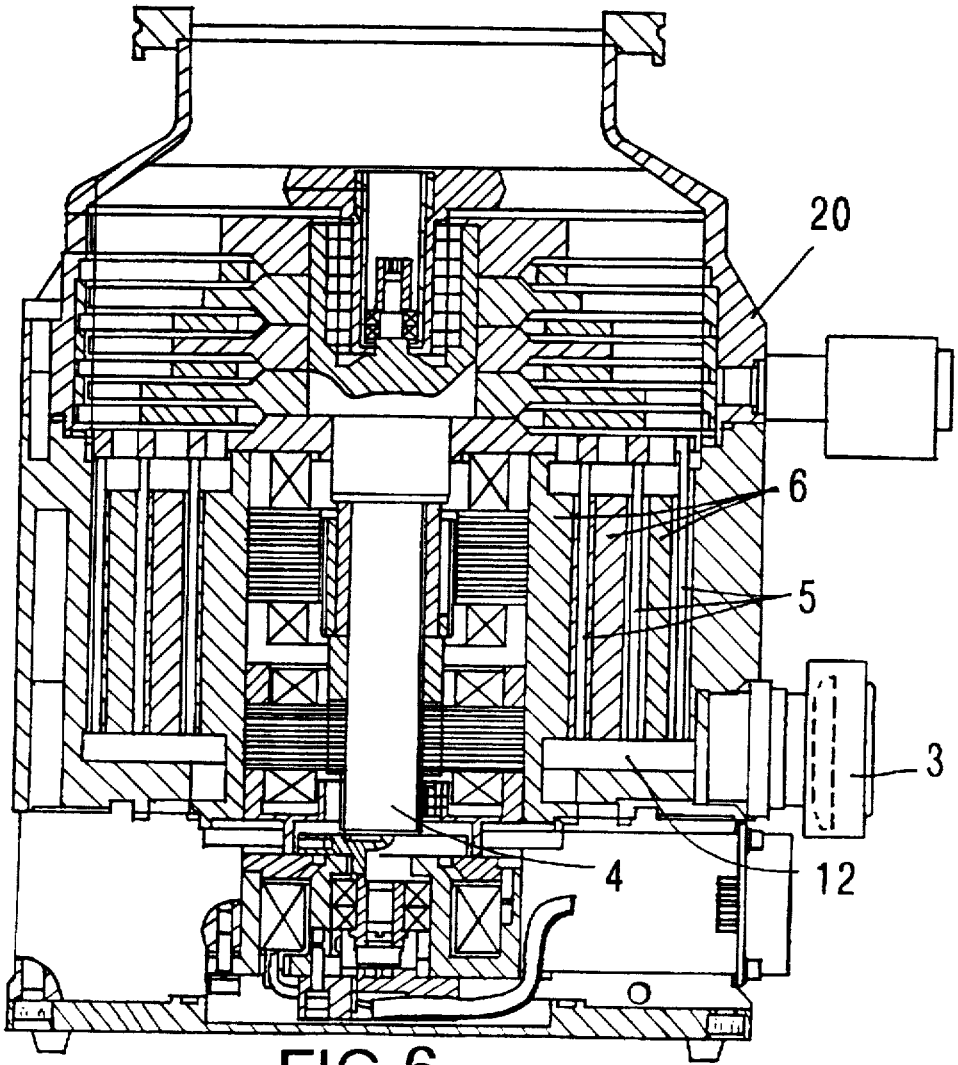
FIG. 6 shows a cross-sectional view of a combination of a gas friction pump according to the present invention with a turbomolecular pump.

FIG. 6 shows the gas friction pump according to the present invention mounted in a common housing with a turbomolecular pump 20. The gas friction pump is arranged on the fore-vacuum side of the turbomolecular pump 20, with the rotors of both the gas friction pump and the turbomolecular pump being mounted on a common shaft.

Though the present invention was shown and described with reference to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A gas friction pump, comprising:

a housing having a suction port and a discharge port;

rotor means located in the housing and formed of a plurality of coaxial first cylindrical elements; and stator means located in the housing and formed of a plurality of second cylindrical elements coaxial with the first cylindrical elements and surrounding respective first cylindrical elements;

wherein ones of the first cylindrical elements and the second cylindrical elements have smooth inner and outer surfaces, and another ones of the first cylindrical elements and the second cylindrical elements have a plurality of parallel discharge channels formed on inner and outer surfaces of the another ones of the first and second cylindrical elements, arranged one beneath another and separated by a respective plurality of webs, the parallel discharge channels defining a plurality of parallel discharge chambers forming a plurality of parallel operating pumping chambers for pumping gas from the suction port to the discharge port, and wherein the pumping chambers pump gas in a single axial direction to the discharge port.

2. A gas friction pump as set forth in claim 1, wherein the ones of the first cylindrical elements and the second cylindrical elements are the first cylindrical elements, and the another ones of the first cylindrical elements and the second cylindrical elements are the second cylindrical elements.

3. A gas friction pump as set forth in claim 1, wherein the ones of the first cylindrical elements and the second cylindrical elements are the second cylindrical elements, and the another ones of the first cylindrical elements and the second cylindrical elements are the first cylindrical elements.

4. A gas friction pump as set forth in claim 1, wherein the parallel discharge channels are formed by spiral grooves.

5. A gas friction pump as set forth in claim 1, further comprising a connection element for connecting the first cylindrical elements and arranged adjacent to the suction port, the connection element having a plurality of openings for connecting the suction port with respective discharge chambers.

6. A gas friction pump as set forth in claim 5, wherein the connection element comprises a plurality of bearing elements which form, together with discharge openings, a gas discharge structure.

7. A gas friction pump as set forth in claim 5, wherein the connection element comprises a plurality of bearing elements formed as vanes which extend at an angle to a plane of the discharge port and direct gas flow to the discharge chambers.

8. A gas friction pump as set forth in claim 5, wherein the connection element includes a plurality of inclined bores which form a discharge structure.

9. A gas friction pump as set forth in claim 1, wherein the another ones of the first cylindrical parts and the second cylindrical parts have a meander-shaped cross-section, with the discharge channels and the webs formed on the inner and outer surfaces being arranged opposite each other.

10. A pump assembly, comprising:

a turbomolecular pump having a rotor, a stator surrounding the rotor, and a fore-vacuum side; and a gas friction pump arranged at the fore-vacuum side of the turbomolecular pump and comprising:

a housing having a suction port and a discharge port;

rotor means located in the housing and formed of a plurality of coaxial first cylindrical elements; and stator means located in the housing and formed of a plurality of second cylindrical elements coaxial with first cylindrical elements and surrounding respective first cylindrical elements, wherein ones of the first cylindrical elements and the second cylindrical elements have smooth inner and outer surfaces, and another ones of the first cylindrical elements and the second cylindrical elements have a plurality of parallel discharge channels formed on inner and outer surfaces of the another ones of the first and second cylindrical elements, arranged one beneath another and separated by a respective plurality of webs, the parallel discharge channels defining a plurality of parallel discharge chambers forming a plurality of parallel operating pumping chambers for pumping gas from the suction port to the discharge port, wherein the pumping chambers pump gas in a single axial direction to the discharge port, and wherein both the rotor of the turbomolecular pump and the rotor of the gas friction pump are arranged on a common shaft.

11. A gas friction pump, comprising:

a housing having a suction port and a discharge port;

rotor means located in the housing and formed of a plurality of coaxial first cylindrical elements; and stator means located in the housing and formed of a plurality of second cylindrical elements coaxial with the first cylindrical elements and surrounding respective first cylindrical elements;

wherein ones of the first cylindrical elements and the second cylindrical elements have smooth inner and outer surfaces, and another ones of the first cylindrical elements and the second cylindrical elements have a plurality of parallel discharge channels formed on inner and outer surfaces of the another ones of the first and second cylindrical elements, arranged one beneath another and separated by a respective plurality of webs, the parallel discharge channels defining a plurality of parallel discharge chambers forming a plurality of parallel operating pumping chambers for pumping gas from the suction port to the discharge port, and wherein the first cylindrical elements and the second cylindrical elements have different axial lengths, whereby an axial expansion of pumping elements which are formed by the first and second cylindrical elements, decreases from inside out.

* * * * *